US005392029A

United States Patent [19]

Chang

[11] Patent Number: 5,392,029

[45] Date of Patent: Feb. 21, 1995

[54] ELECTRICAL SHOCK APPARATUS

[76] Inventor: Hong-Yih Chang, No. 336, Chengkeng Rd., Fengyuan City, Taichung Hsien, Taiwan, Prov. of China

[21] Appl. No.: 234,229

[22] Filed: Apr. 28, 1994

[51] Int. Cl.[6] ..... G08B 15/00

[52] U.S. Cl. ..... 340/574; 273/84 ES; 340/691; 361/232

[58] Field of Search ..... 340/574, 691; 361/232; 273/84 ES; 119/908; 231/7

[56] References Cited

U.S. PATENT DOCUMENTS

| | | | |
|---|---|---|---|
| 4,093,969 | 6/1978 | Maynor, Jr. | 361/232 |
| 4,872,084 | 10/1989 | Dunning et al. | 361/232 |
| 4,908,606 | 3/1990 | Kevonian | 340/574 |
| 4,968,034 | 11/1990 | Hsien | 361/232 |
| 5,289,164 | 2/1994 | Novak | 340/574 |

*Primary Examiner*—Glen Swann

*Attorney, Agent, or Firm*—Hamilton, Brook, Smith & Reynolds

[57] ABSTRACT

An electrical shock apparatus includes a power source, a high voltage generation device for generating a very high voltage to shock a robber in response to a connection to the power source, an alarm device for generating an alarming sound to shock a robber in response to a connection to the power source, a function selection switch switchably connecting the power source to either the high voltage generation device, the alarm device, or an empty connection. A pin-socket switch is connected between the power source, the function selection switch, and the alarm device. The pin-socket switch includes a socket and a pin removably received in the socket. Normally, the pin of the pin-socket switch is retained in the socket and electrically connects the function selection switch to the power source yet separates the alarm device from the power source. The function selection switch electrically connects the power source to the empty connection via the pin-socket switch in normal condition. A user is allowed to select either high voltage or alarm sound to shock a robber by appropriately operating the function selection. The user can pull the pin from the socket causing an alarm sound to shock a robber when the robber is going to take control of the electrical shock apparatus.

5 Claims, 2 Drawing Sheets

ELECTRICAL SHOCK APPARATUS

BACKGROUND OF THE INVENTION

1. Field of the Invention

The present invention relates to an electrical shock apparatus, especially one which is easily controlled by a user to provide relatively high instant voltage to scare a robber, an attacker, a thief etc. when the user handles the electrical shock apparatus, or disables the high voltage output and alarms to scare the robber when it is going to be taken over by the robber.

2. Description of the Prior Art

An electrical shock device is used for scaring robbers thus is popular in these times when people are concerned for their personal safety. Sometimes if the user can not operate the electrical shock device properly, the robber may wrest it from the user and attack the user by the electrical shock device. It is requisite to provide a new electrical shock apparatus which can output high instant voltage to shock a robber when it is under control by a user or to disable itself and alarm upon operation by the user if the robber is going to take control of the electrical shock apparatus.

SUMMARY OF THE INVENTION

The primary objective of the present invention is to provide an electrical shock apparatus which is operative to either emit very high instant voltage to shock a robber or an alarming sound to shock a robber.

In accordance with one aspect of the invention, there is provided an electrical shock apparatus comprising a power source for generating a DC voltage; a high voltage generation circuit for generating a very high voltage in response to a connection to the power source; an alarm device for generating an alarming sound in response to a connection to the power source; a function selection switch including a first output terminal connected to the high voltage generation circuit, a second output terminal connected to the alarm device, and an input terminal electrically connected to the power source, the input terminal being operative to electrically connect the power source to the high voltage generation circuit or the alarm device; a socket-pin switch including a socket, a first terminal, a second terminal, a third terminal and a pin removably received in the socket, the first terminal being electrically connected to the power source, the second terminal being electrically connected to the alarm device, the third terminal being electrically connected to the input terminal of the function selection switch, the pin being removably received in the socket thus electrically connecting the third terminal to the first terminal and separating the second terminal from the first terminal, the second terminal being electrically connected to the first terminal and the third terminal being separated from the first terminal when the pin is manually removed from the socket.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
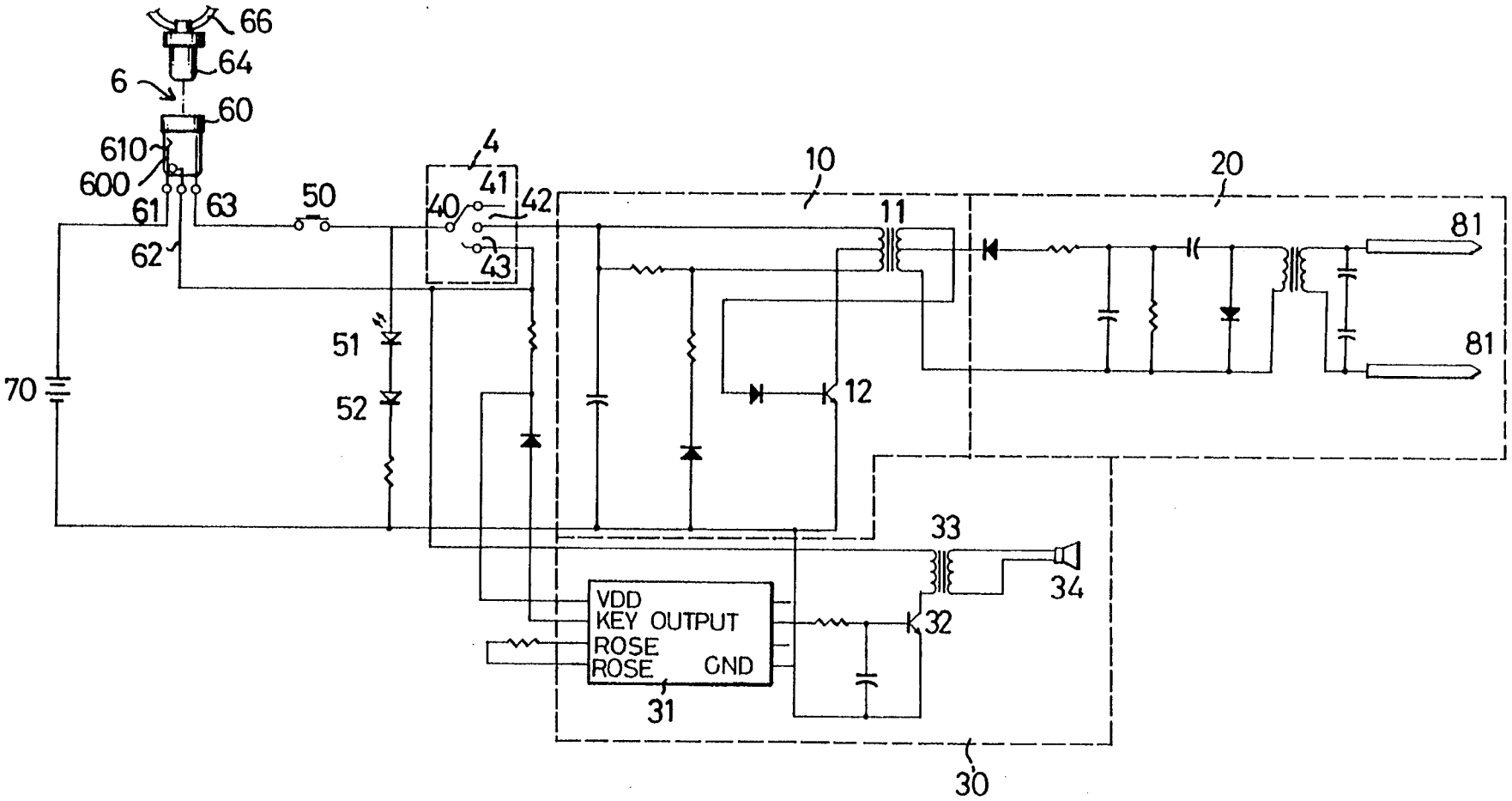
FIG. 1 is a circuit diagram of an electrical shock apparatus in accordance with the present invention.

Referring to FIG. 1, an electrical shock apparatus of the present invention comprises a power source 70 for providing a DC voltage, a high voltage generation circuit which includes an oscillator/first voltage pullup device 10 and a second voltage pullup device 20 for generating a very high voltage signal in response to a connection to the power source 70, and an alarm device 30 for generating an alarm sound in response to a connection to the power source 70. The power source 70 can be such as batteries connected in series. The oscillator/first voltage pullup device 10 comprises a first transformer 11 and a transistor 12 for converting the DC voltage to an oscillation signal. The second voltage pullup device 20 receives and amplifies the oscillation signal to a very high voltage signal and outputs the very high voltage signal from a pair of electrodes 81. The alarm device 30 comprises a sound pattern generation circuit 31, a transistor 32, a transformer 33, and a speaker 34. The sound pattern generation circuit 31 is a commercially available integrated circuit which receives the DC voltage supply and generates a predetermined sound-pattern signal in response. The sound-pattern signal is amplified by the transistor 32 and a corresponding alarm sound is outputted from the speaker 34 in response.

A function selection switch 4 comprises an input terminal 40 connected to a safety switch 50 connected to a pin-socket switch 6 connected to the DC power source 70, a first output terminal 41 not connected to anything, a second output terminal 42 connected to the oscillator/first voltage pullup device 10, and a third contact 43 connected to the alarm device 30. The input terminal 40 is switchably in electrical connection with one of the three output terminals 41–43. Normally, the input terminal 40 is electrically connected to the first output terminal 41. The function selection switch 4 is operative to electrically change the connection of the input terminal 40 from the first output terminal 41 to either the second output terminal 42 or the third output terminal 43, thereby electrically connecting the DC power source 70 to either the oscillator/first voltage pullup device 10 or the alarm device 30.

The pin-socket switch 6 comprises a socket 60 and a pin 64 removably received in the socket 60. The socket 60 includes a first contact 61, a second contact 62, and a third contact 63. A leaf spring 600 including a first end secured to the first contact 61 and a curved end 610 in free connection. The pin 64, the leaf spring 600, the contacts 61, 62, 63 are all conductors. Normally the pin 64 is retained in the socket 60, and the first contact 61 is electrically Connected to the third contact 63 via the pin 64, yet the second contact 62 is separated from the first contact 61. The second contact 62 is electrically connected to the first contact 61 and the battery 70 is electrically connected to the alarm device 30 when the pin 64 is removed from the socket 60. In short, the pin-socket switch 6 electrically connects the power source 70 to the function switch 4 normally, and electrically connects the power source 70 to the alarm device 30 when the pin 64 is pulled out from the socket 60. It is noted that the pin 64 is allowed to be re-inserted into the socket 60, abutting against the curved end 610 of the leaf spring 600, disconnecting the first contact 61 from the second contact 62 and electrically connecting the first contact 61 to the third contact 63, thereby electrically connecting the power source 70 to the function selection switch 4.

A light emitting diode 51 and a diode 52 are connected in series with the safety switch 50, the pin-socket switch 6, and the power source 70. Normally, the safety switch 50 is turned off, thus the light emitting diode 51 is in an off status. The light emitting diode 51 emits light to illustrate the power source 70 is not dead when the safety switch 50 is turned on.

Figure 2:
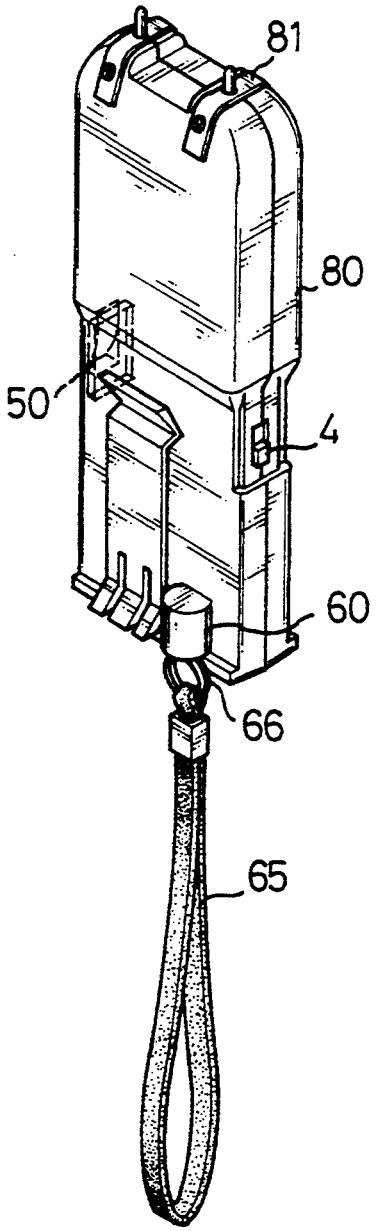
FIG. 2 is a perspective view of an electrical shock apparatus in accordance with the present invention.

Referring to FIG. 2, the electrical shock apparatus is formed as a casing structure 80 for receiving circuit components therein and including at the periphery thereof the pair of electrodes 81, the function selection switch 4, the socket 60 of the pin-socket switch 6, and the safety switch 50. A strap 65 is connected to a ring 66 which is connected to the pin 64 of the pin-socket switch 6 (see FIG. 1). A user can operate the function selection switch 4 to selectively activate either the high voltage generation circuit to generate a very high voltage signal or the alarm device 30 to output an alarm sound to shock a robber. A user can pull out the pin 64 by pulling out the strap 65 thus cutting off the power supply to the function selection switch 4 and in the mean time turning on the alarm device 30 (see FIG. 1) when a robber is going to take control of the electrical shock apparatus. Therefore, even when a robber grasps the electrical shock apparatus, he/she can not attack the original user with high voltage shock. It should be noted that the strap 65 can guarantee the user can detach it from the electrical shock apparatus when a robber is going to take control of the electrical shock apparatus.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. An electrical shock apparatus comprising a power source for generating a DC voltage;

a high voltage generation circuit for generating a very high voltage in response to a connection to said power source;

an alarm device for generating an alarming sound in response to a connection to said power source;

a function selection switch including a first output terminal connected to said high voltage generation circuit, a second output terminal connected to said alarm device, and an input terminal electrically connected to said power source, said input terminal being operative to electrically connect said power source to said high voltage generation circuit or said alarm device;

a socket-pin switch including a socket, a first terminal, a second terminal, a third terminal and a pin removably received in said socket, said first terminal being electrically connected to said power source, said second terminal being electrically connected to said alarm device, said third terminal being electrically connected to said input terminal of said function selection switch, said pin being removably received in said socket thus electrically connecting said third terminal to said first terminal and separating said second terminal from said first terminal, said second terminal being electrically connected to said first terminal and said third terminal being separated from said first terminal when said pin is manually removed from said socket.

2. An electrical shock apparatus as claimed in claim 1, wherein said high voltage generation circuit comprises an oscillator/first voltage pullup and a second voltage pullup for converting said DC voltage from said power source to a very high voltage signal.

3. An electrical shock apparatus as claimed in claim 1, wherein said alarm device comprises a sound pattern generation circuit, a transistor, a transformer, and a speaker, said sound pattern generation circuit generating a predetermined sound-pattern signal in response to said DC voltage from said power source, said transistor amplifying said sound-pattern signal, said speaker outputting a corresponding alarm in response to said amplified sound-pattern signal.

4. An electrical shock apparatus as claimed in claim 1 further comprising a safety switch connected between said third terminal of said pin-socket switch and said input terminal of said function selection switch.

5. An electrical shock apparatus as claimed in claim 1 further comprising a strap connected to the pin allowing a user to easily pull the pin when a robber is going to take control of the electrical shock apparatus.

* * * * *